US008919616B2

(12) United States Patent
Obrist

(10) Patent No.: US 8,919,616 B2
(45) Date of Patent: Dec. 30, 2014

(54) CARTRIDGE PISTON

(75) Inventor: Manfred Obrist, Lustenau (AT)

(73) Assignee: Sulzer Mixpac AG, Haag (CH)

( * ) Notice: Subject to any disclaimer, the term of this patent is extended or adjusted under 35 U.S.C. 154(b) by 698 days.

(21) Appl. No.: 12/592,265

(22) Filed: Nov. 20, 2009

(65) Prior Publication Data

US 2010/0147896 A1 Jun. 17, 2010

(30) Foreign Application Priority Data

Dec. 12, 2008 (EP) ..... 08171571

(51) Int. Cl.
*B65D 88/54* (2006.01)

(52) U.S. Cl.
USPC ..... 222/327; 222/326; 222/386

(58) Field of Classification Search
USPC ..... 222/325–327, 386, 387; 92/172
See application file for complete search history.

(56) References Cited

U.S. PATENT DOCUMENTS

| | | | | |
|---|---|---|---|---|
| 4,819,836 | A * | 4/1989 | Meckenstock | 222/386 |
| 5,170,913 | A * | 12/1992 | Spatz | 222/209 |
| 5,178,305 | A * | 1/1993 | Keller | 222/386 |
| 5,377,880 | A * | 1/1995 | Moretti | 222/207 |
| 6,494,348 | B2 * | 12/2002 | Prestele | 222/326 |
| 6,598,766 | B1 * | 7/2003 | Brugner | 222/326 |
| 6,899,254 | B1 * | 5/2005 | Sandholm et al. | 222/387 |
| 7,748,577 | B2 * | 7/2010 | Brugner | 222/387 |
| 8,235,255 | B2 * | 8/2012 | Springhorn et al. | 222/386 |
| 2005/0029306 | A1 * | 2/2005 | Brennan | 222/327 |

FOREIGN PATENT DOCUMENTS

| | | |
|---|---|---|
| DE | 200 10 417 U1 | 10/2001 |
| DE | 203 19 464 U1 | 4/2004 |
| DE | 20 2005 000531 U1 | 8/2005 |
| EP | 1 165 400 B | 1/2003 |

* cited by examiner

*Primary Examiner* — Frederick C Nicolas
(74) *Attorney, Agent, or Firm* — Francis C. Hand; Carella, Byrne, Et Al

(57) ABSTRACT

The piston includes a piston body having a conveying side, an oppositely disposed drive side and, at the circumferential side, a piston jacket forming a connection between the conveying side and the drive side. The piston jacket has a projection that carries a guide element for the guidance of the piston in a cartridge containing a filling with solid particles and for forming a sealing contact with a wall of the cartridge. The projection also carries a scraper element in front of the guide element for scraping solid particles from the cartridge wall back into the filling during discharge.

11 Claims, 6 Drawing Sheets

Prior Art

CARTRIDGE PISTON

FIELD OF THE INVENTION

This invention relates to a piston for a cartridge, in particular for the discharge of fillings containing solids. More particularly, this invention relates to a piston for a cartridge for dispensing a multicomponent mixture.

BACKGROUND OF THE INVENTION

Pistons for cartridges for dispensing a multicomponent mixture are known, for example, from DE 200 10 417 U1, wherein the piston has a first piston part which is provided with a sealing lip that contacts the cartridge wall.

Another piston is disclosed in EP 1 165 400 B1 wherein the piston is made up of a soft plastic, for example LDPE (low density polyethylene) in order to achieve the required sealing effect toward the cartridge wall. However, such a piston may only be compatible with limitations with materials which form the filling of the cartridge. To avoid the piston coming into contact with such materials along its conveying side, a cover plate is used which is made of a plastic which is resistant to the filling. The cover plate covers a large part of the cross-sectional surface on the conveying side, with the exception of the marginal region which is adjacent to the cartridge wall. The marginal region is formed by a limb which extends outside the cover plate along the outer periphery of the piston in the direction of the conveying side. The limb is separated from the cover plate by a V-shaped groove. The limb in this embodiment is admittedly in contact with the filling, but the other regions of the piston are screened off by the cover plate. It applies to most fillings that a contact with the piston material results in a swelling of the piston material so that an expansion occurs in the region of the limb. This has the advantage that the sealing effect is in all events amplified. Alternatively to this, a plurality of sealing lips can also be arranged at the piston circumference, such as is known, for example, from CH 610 994.

However, these already known pistons have proved to be unsuitable for the discharge of fillings containing solids. Solids can enter into the intermediate space between the end of the limb and the sealing lip and remain captured in the intermediate space. If the discharge procedure is continued, the sealing lip sweeps over the solid grain contacting the cartridge wall. The contact of the sealing lip with the cartridge wall is lost, the sealing effect is accordingly no longer present.

A solution for this problem lies in providing a sealing lip which is located at the outermost end of the limb. However, such a sealing lip is not suitable for a practical application since the lip is easily damaged on the introduction of the piston into the cartridge. This problem can be remedied in that the piston itself is made deformable as, for example, the piston of CH 610 994.

However, the piston of CH 610 994 can only be used with an expulsion plunger of the piston adapted to the geometry of the piston when viscous or pasty media are to be discharged from a cartridge using this piston. This means this piston is not compatible with commercial discharge devices.

Accordingly, it is an object of the invention to provide an improvement to the named piston so that materials containing solids can be discharged using the piston, with the imperviousness of the piston remaining ensured.

It is another object of the invention to provide at piston that is displaceable in a cartridge by means of commercial discharge devices.

Briefly, the invention provides a piston for a cartridge that has a filling containing solid particles. The piston is displaceable in the cartridge to discharge the filling and has a scraper element which serves for the scraping of solid particles from the wall of the cartridge during discharge.

The piston includes a piston body having a conveying side, an oppositely disposed drive side and a piston jacket on the circumferential side forming a connection between the conveying side and the drive side. The piston jacket is arranged about a piston axis and merges on the conveying side into a projection which has a guide element for the guidance of the piston in the cartridge and for establishing a sealing contact with the wall of the cartridge. The conveying side is the side of the piston which is in contact with the filling while the drive side is the opposite side articulated to a drive mechanism, such as a plunger.

The projection includes a scraper element which has a surface that is at a smaller spacing from the conveying side than the guide element. The surface is usually part of a plane which is normal to the piston axis. The surface does not have to coincide with this plane, but can deviate from it if the piston has a curvature or has cut-outs and projections for the reception of stiffening elements, protective elements, venting elements and the like. A reference surface is assumed for the determination of the relative distance from the conveying element and the scraper element, said reference surface being in a plane which is spanned normal to the piston axis and contains the point or points of the piston which project the furthest into the filling. Or in other words: If the piston were placed with its conveyer side onto a planar surface and were aligned such that its piston axis is normal to this surface, this planar surface forms the reference surface. In accordance with this definition, the scraper element has a smaller distance from the reference surface than the guide element. Solids are hereby taken up by the scraper element during the discharge of the filling out of the cartridge and are expelled by the scraper element or are deflected in the direction of the piston axis so that the solid particles are completely discharged with the filling.

The scraper element has an edge which contains the points of the scraper element furthest away from the piston axis in the radial direction.

The guide element has a spacing from the piston axis in the radial direction which is larger than the spacing of the edge from the piston axis. This means that the guide element has a larger diameter than the edge. The guide element contacts the wall of a cartridge when the piston is located in the cartridge. The guide element can even have a diameter which is larger than the inner diameter of the cartridge, that is, the guide element can have an oversize with respect to the inner diameter of the cartridge. The sealing of the conveyer-side piston space from the drive side thus takes place by means of the guide element.

The edge of the scraper element has a radial spacing R1 from the piston axis and the guide element has a spacing R2 from the piston axis, with the difference amounting to a maximum of 0.5 mm, preferably 0.3 mm, particularly preferably 0.2 mm. Because the scraper element thus has a smaller radial extent than the guide element, the scraper element is not damaged on the assembly of the piston with the cartridge. As soon as the scraper element is introduced into the cartridge, the piston is centered by the scraper element and a tilting can be avoided. If the piston is moved further into the inner space of the cartridge, the guide element comes into contact with the wall of the cartridge at the circumferential side. Since, at best, small inclined positions of the piston are possible due to the centration of the scraper element, the contact pressure exerted by the wall onto the guide element will be distributed evenly over the periphery of the guide element. Damage of the guide element can hereby be avoided. The guide element can thus exert its sealing function as soon as the scraper element is in contact with the wall of the cartridge.

The edge of the scraper element bounds a support surface which is arranged between 80° and 110° relative to the piston axis and, in particular, substantially normal to the piston axis. A support surface of the scraper element thus adjoins the edge. This support surface proportionally takes up the compressive forces during the discharge of the filling which are exerted by the filling onto the piston when the filling should be discharged from the cartridge. The compressive forces acting on the support surface have a resultant force which extends in the direction of the piston axis. If the support surface is arranged at an angle of 80° to 110° to the piston axis, the compressive forces have the effect that the projection belonging to the scraper element is deformed such that the edge of the scraper element comes into contact with the wall of the cartridge.

In the projections known from the prior art, such as are shown in EP 1 165 400 B1, the projection has an inclined surface instead of an edge. The inclination thereof is designed such that the spacing between the projection and the cartridge wall increases in the direction of the conveying side. This inclined surface has the advantage that the piston can be introduced better into the cartridge. In particular when the projection has a diameter which is larger than the inner diameter of the associated cartridge, the piston can be positioned more easily in the bore of the cartridge. The end of the projection is in contact with the cartridge wall at the start of the assembly procedure of the piston in the cartridge. The further the cartridge is pushed into the bore, the further the contact line between the projection and the cartridge wall moves away from the end of the projection. At the same time, the projection undergoes an ever larger bias. The diameter of the projection increases more and more along the inclined surface. Since the inner diameter of the cartridge wall is, however, preset, the projection is deformed such that it can engage into the inner space of the cartridge. It also results from this that the projection is pressed toward the wall with an increasing contact pressure the further the assembly procedure progresses. This has the consequence that in the end position, when the piston has been pushed so far into the inner space of the cartridge that the sealing lip comes to lie at the inner wall, the end of the projection comes to lie at a spacing from the cartridge wall. The inclined surface remains present. When the piston is displaced by a discharge device, for example a plunger, for the discharge of the filling, the inner pressure of the filling exerts a force in the direction of the piston axis onto the inclined surface. This force can be divided into a force component directed normal to the inclined surface and into a force component directed in the direction of the inclined surface. It results from the force diagram that the force directed normal to the inclined surface attempts to move the projection away from the cartridge wall.

If a solid particle enters between the inclined surface and the cartridge wall, the solid particle supports this tendency. The solid particle is clamped, further and further into the gap between the inclined surface and the cartridge wall by the pressure of the filling. Since the piston and the sealing lip are made up of soft material, the piston material yields and the solid particle can pass the sealing lip. The contact between the sealing lip and the cartridge wall is hereby interrupted so that the solid particle and further filling material can emerge. This lack of seal is a problem which frequently occurs in the solutions of the prior art, in particular on the processing of fillings which contain solid particles.

The support surface advantageously has a section which includes an angle of up to 80°, preferably up to 60°, particularly preferably up to 45°, with the support surface. The angle can be determined as follows: a normal plane to the piston axis is laid by the edge of the support surface facing the piston axis. This normal plane is intersected by a plane which extends in the direction of the piston axis and which contains the edge, so that a line of intersection results. The angle is spanned between the line of intersection and the section line of the section with the plane extending in the direction of the piston axis.

The section is located on the side of the projection which is aligned to the piston axis, that is at the inner side of the projection. A compressive force which is caused by the filling likewise acts on the section. This force can in turn be divided into two force components, a normal component which is aligned normal to the section as well as a component which extends in the direction of the section. The section, and thus the projection including the edge, is pressed toward the wall of the cartridge by the normal component. The path for the solid particles is thus blocked; it is therefore possible to avoid solid particles coming to lie between the cartridge wall and the projection. It results from this that a deflection of any solid particles into the inner space of the piston takes place by means of the projection.

In another embodiment, the same advantage results for a ring-shaped piston. Such a ring-shaped piston additionally includes an inner piston jacket, with the inner piston jacket bounding the piston body at an inner side facing the piston axis, including an inner projection which includes an inner guide element for the guidance of the piston along the piston axis, with the inner guide element being suitable to establish a sealing contact with a wall of an inner tube. The inner projection includes an inner scraper element which has a smaller spacing from the conveying side than the guide element.

The ring-shaped piston also has as inner scraper element that includes an inner edge, with the inner edge containing the points of the inner scraper element least far away from the piston axis in the radial direction.

The inner guide element has a spacing from the piston axis in the radial direction which is smaller than or equal to the spacing of the inner edge from the piston axis.

The inner edge has a radial spacing R3 from the piston axis and the guide element has a radial spacing R4 from the piston axis, with the difference between R3 and R4 amounting to a maximum of 0.5 mm, preferably 0.3 mm, particularly preferably 0.2 mm.

The piston of either embodiment can be designed such that a protective element is attached to the piston body at the conveying side. Such a protective element can be made of a material which has a higher resistance with respect to the filling than the piston material. The protective element can thus develop a protective function for the piston material.

The piston body or the protective element can contain a venting element. This venting element serves to remove gases from gas inclusions from the inner piston space which arise, for example, on the insertion of the piston into the cartridge wall. The gas can in particular be air.

Stiffening ribs can be arranged on the drive side of the piston. The provision of stiffening ribs ensures that the piston remains inherently stable even if the piston is put under pressure by means of a discharge device on the discharge of the filling.

A tilt securing element can be arranged on the drive side of the piston and serves for the improvement of the guidance of the piston in a cartridge. The piston is guided securely against tilting by the tilt securing element which is in contact with the wall of the cartridge, thus the axis of the piston body coincides with the piston axis. The tilt securing element ensures that the conveying side is arranged in a normal plane to the piston axis or, if the conveying side is not planar, that points of the piston surface at the conveying side which are characterized by a specific radius and a specific height are disposed in substantially the same normal plane along the periphery. If the piston were to tilt, the condition for such points would not be satisfied. A contact with the wall of the cartridge at the circumferential side can be maintained during the whole discharge procedure by such a tilt securing element so that a deflection of the piston can be prevented together with the previously described guide element.

The advantages of the special features which the annular piston can have correspond to the advantages such as have been listed earlier in connection with a piston for a cylindrical inner space or an inner space of a different design without installations.

A discharge apparatus includes a piston in accordance with one of the preceding embodiments. The discharge apparatus includes a cartridge for the discharge of a plurality of components, with the components being arranged in cavities of the cartridge arranged next to one another or coaxially. Furthermore, the discharge apparatus can include a discharge device by means of which the piston can be connected at the drive side.

The piston in accordance with one of the preceding embodiments is particularly advantageously used for the discharge of fillings containing solids as well as pasty or viscous compounds.

BRIEF DESCRIPTION OF THE DRAWINGS

These and other objects and advantages of the invention will become more apparent from the following detailed description taken in conjunction with the accompanying drawings wherein.

DETAILED DESCRIPTION OF THE INVENTION

Figure 1:
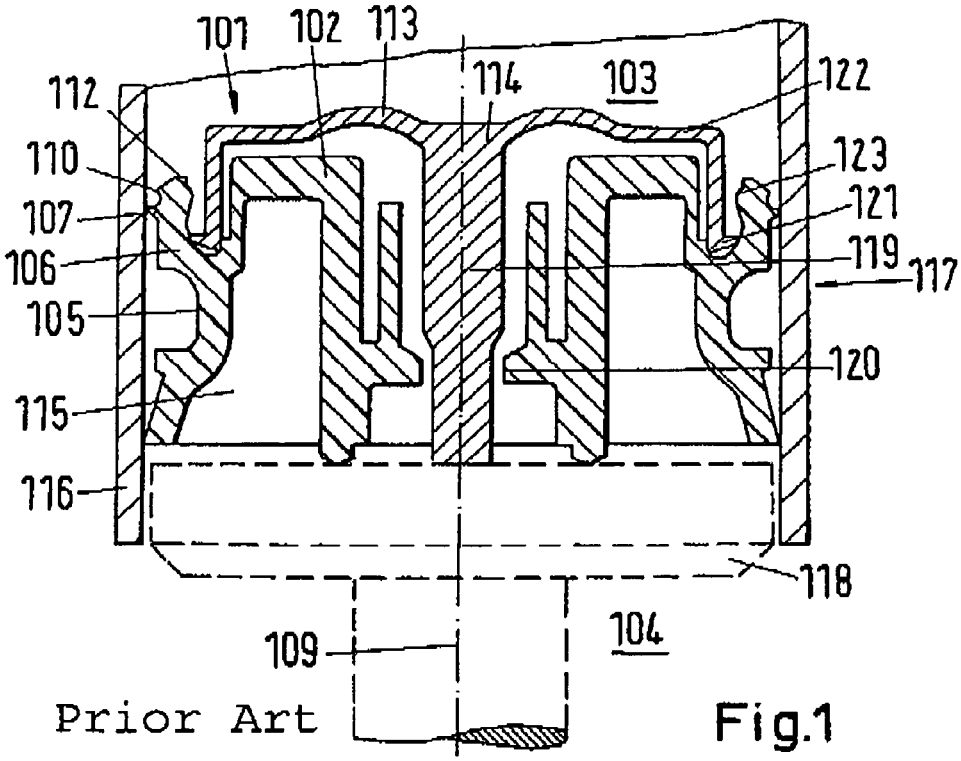
Prior Art Fig.1
FIG. 1 illustrates a piston in accordance with the prior art.

Referring to FIG. 1, a piston 101, as is known from the prior art, includes a piston body 102 which is usually manufactured by means of an injection molding process from plastic. The piston 101 is preferably used to discharge a filling, in particular of fluid or pasty media, from a cartridge. A wall 116 of the cartridge 117 is shown. The piston 101 slides along the wall 116 and, during this movement, pushes the filling through a discharge opening (not shown). The side of the piston 101 at the media side is defined as the conveying side 103 in the following. To set the piston into motion and to keep the piston in motion, a compressive force is applied by means of a discharge device. The discharge device, of which a plunger element 118 is shown, is located on the side of the piston which is disposed opposite the conveying side 103. This side is defined as the drive side 104 in the following.

"The piston body 102 is thus bounded by the drive side 104, the conveying side 103 and by a piston jacket 105 that forms the connection between the drive side 104 and the conveying side 103. In most cases, the piston body 102 has a plurality of cut-outs or is made as a hollow body. Such pistons are already made as thin-walled components from diameters of a few centimeters for reasons of saving material as well as due to the difficulties which the injection molding of thick-walled components gives rise to. The piston receives the required shape stability through stiffening ribs 115.

The piston can additionally contain a protective element 113. A protective element 113 can be made as a cover plate whose function consists of screening the piston body form the filling. A cover plate is used when the filler material is prone to attacking the piston material. This applies in particular to pistons of soft plastic such as LDPE. LDPE is attacked, for example, by polyester resins and swells up.

The piston 101 can also contain a venting element 114. Gas which is located in the inner space of the cartridge 117 between the filling and the piston 101 can escape to the outside through the venting element 114, that is to the drive side 104, without the filling emerging. The venting element 114 is closed as long as the cartridge is stored in the filled state. If the filling should be discharged, the discharge device 118 is brought into contact with the piston on its drive side 104. In this respect, the discharge device also comes into contact with a spigot 119 of the venting element 114. The spigot projects beyond the surface which enters into contact with the discharge device on the drive side so that the spigot lifts off its seat 120 when the discharge device 118 comes into contact with the drive side 104. The flow path for the gas is opened in this respect. The gas enters via the flanks 121 of the valve body 122 formed as a cover plate into the intermediate space between the valve body 122 and the piston body 102 and leaves the piston via the opened flow path through the opening between the spigot 119 and the seat 120.

The flanks 121 are in engagement with the piston body 102 via latch connections. For this purpose, the flank 121 engages, for example, into a circumferential groove 123 of the piston body 102 on the conveying side 103. This is shown in detail in FIG. 2. The flank can also have a sealing lip 124 which engages into a cut-out 125 of a projection 106 of the piston 101. A plurality of small cut-outs is usually provided in the flank for the gas. A labyrinth-like connection path adjoining these cut-outs can be provided between the piston body 102 and the cover plate 113. Any filler material passing through the cut-outs is deposited along this labyrinth-like connection path. This connection path is not shown in any more detail in the drawing.

The piston 101 otherwise has to have means against the discharge of filling onto the drive side. For this purpose, at least one sealing lip is usually provided along the sliding surface at the wall of the cartridge. In the present embodiment, this sealing lip is shown as a guide element 107, see in particular also FIG. 2. The guide element 107 is located at a projection 106 which extends between the groove 123 and the wall of the cartridge. The projection 106 is made as an arm which is in connection with the piston body 102. What is not visible in the sectional figure is the fact that the arm belongs to a ring-shaped bead which extends along the total circumference of the piston body 102 and forms a fluid-tight connection with the wall 116 of the cartridge 117.

Figure 2:
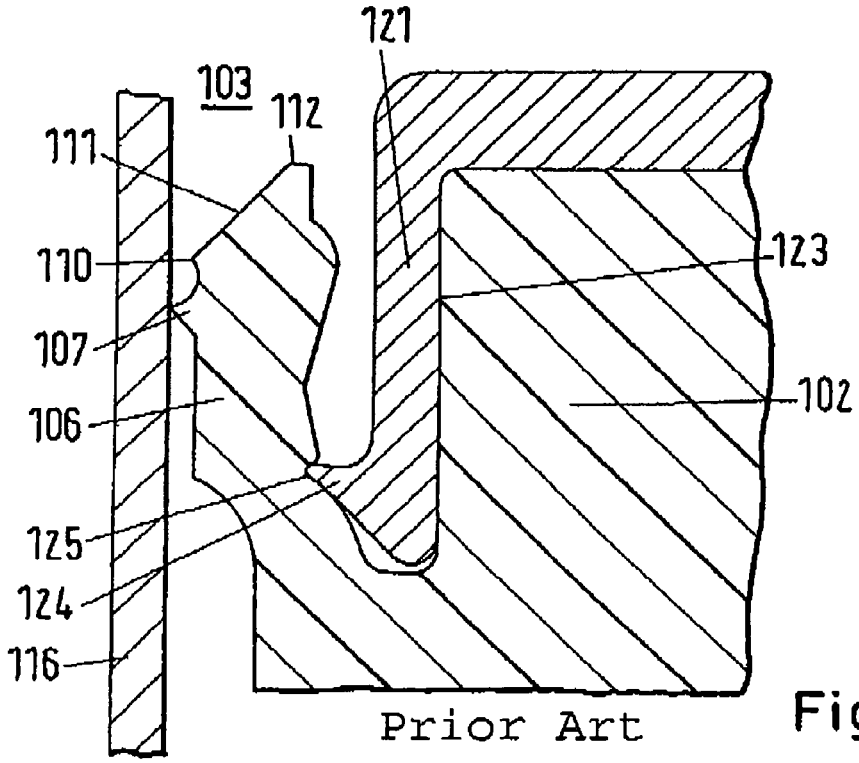
Prior Art Fig.2
FIG. 2 illustrates a section from FIG. 1.

Referring to FIG. 2 wherein the projection 106 is illustrated in enlarged form. As illustrated, the projection includes a guide element 107 which is intended for contact at the wall 116 of the cartridge 117. An edge 110 as well as a support surface 111 adjoin the guide element 107 in the direction of the conveying side 103. A further edge or a section 112 which projects into the filling can adjoin the support surface. The support surface is inclined with respect to the wall of the cartridge, and indeed such that the distance of the support surface from the wall increases as the spacing from the guide element increases. The edge 110 is the end of the support surface which has the smallest spacing from the wall of the cartridge; the section 112 contains the oppositely disposed end of the support surface which has the largest spacing from the wall of the cartridge. The inclination of the support surface is selected for the reason that the piston can be introduced easily into the inner space of the cartridge. The piston may not tilt and may not adopt a slanted position during the introduction of the cartridge since the sealing lip can be damaged in this case. For this reason, the support surface 111 is provided with an inclination so that the piston remains in the correct position with respect to the wall 116 of the cartridge. The piston axis 109 is parallel to the wall 116 of the cartridge in the correct position.

Figure 3:
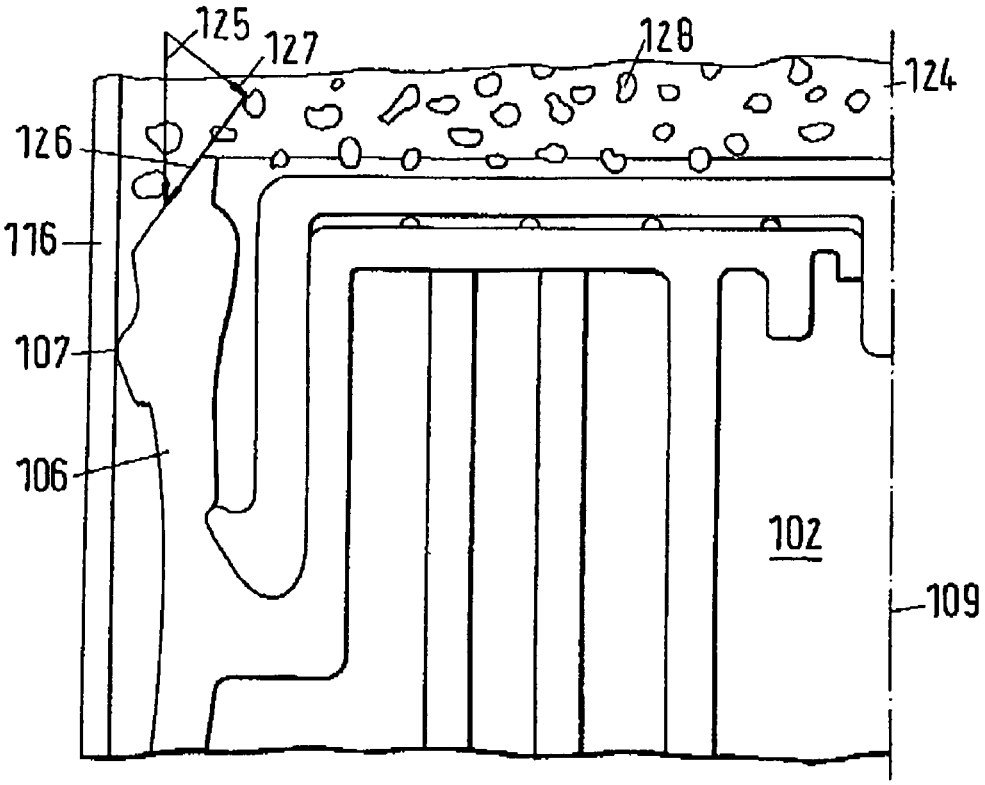
Fig.3 Prior Art
FIG. 3 illustrates a representation of the start of the discharge of a filling containing solids using a piston in accordance with FIG. 1 in accordance with the prior art.
Figure 4:
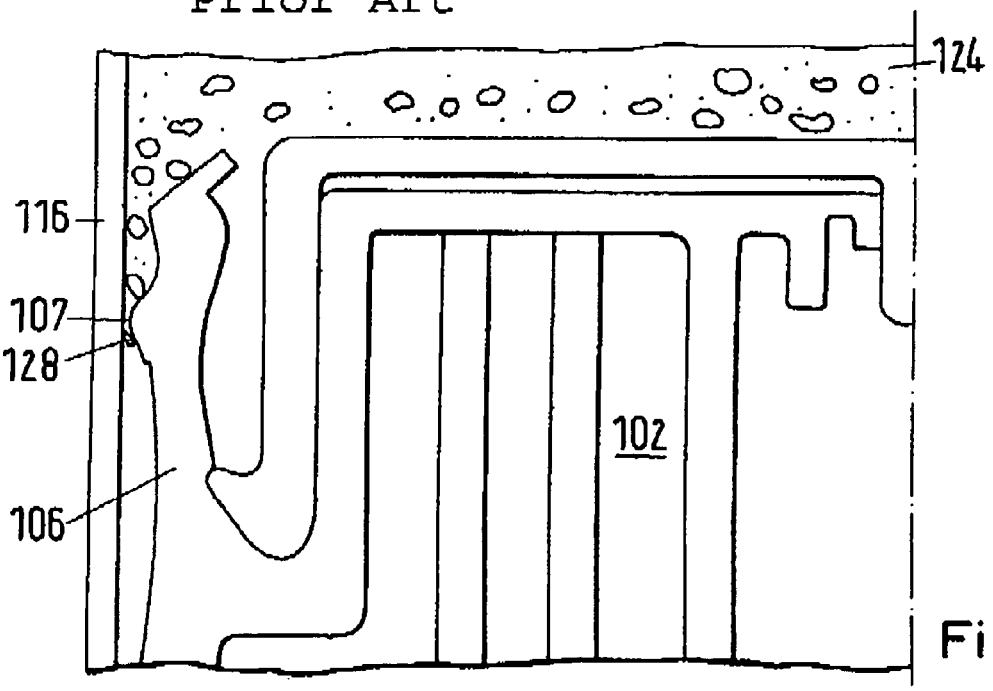
FIG. 4 illustrates a representation of the discharge of a filling containing solids using a piston in accordance with FIG. 1 in accordance with the prior art.

FIG. 3 shows a representation of the start of the discharge of a filling containing solids using a piston in accordance with FIG. 1 in accordance with the prior art and FIG. 4 shows a representation how the discharge can appear at a subsequent point in time.

In FIG. 3, the projection 106 is already introduced into the inner space of the cartridge. The piston lies with the guide element 107 on the wall 116 of the cartridge. The filling 124 is located on the conveying side 103 of the piston. Only a part of the piston 101 is shown so that the details can be recognized better. The projection is made the same as described in FIG. 1 or FIG. 2. If the piston body 102 is now moved toward the filling in the direction of the piston axis 109 by a discharge device (not shown) a compressive force from the filling acts on the piston. This compressive force also acts on the projection and in particular on the support surface 111. The resultant force of the compressive force, which is shown by an arrow 125, acts against the discharge direction. The resultant force of the compressive force can be divided as a vectorial parameter into a tangential component 126 and a normal component 127. The normal component of the force can cause deformations by bending of the projection 106. It results directly from FIG. 3 that the projection 106 tends to be moved away from the wall of the cartridge by the normal component 127.

The position of the projection on an advanced discharge is shown in FIG. 4. The gap between the support surface 111 and the wall 116 is therefore in all events larger due to the inner pressure. If the filling now contains solids, which are shown as particles 128 in FIG. 3 or 4, individual particles can enter into the gap between the support surface and the wall. If the discharge progresses further, the particles will penetrate further and further into the gap. In particular when the particles have a greater hardness than the plastic of the piston, the particles damage the plastic, in particular the sealing lip, or are avoided by the plastic, that is the curvature of the sealing lip, thus loses the contact to the wall and the particles can—together with filling compound—be discharged from the inner space of the cartridge, as shown in FIG. 4.

Figure 5:
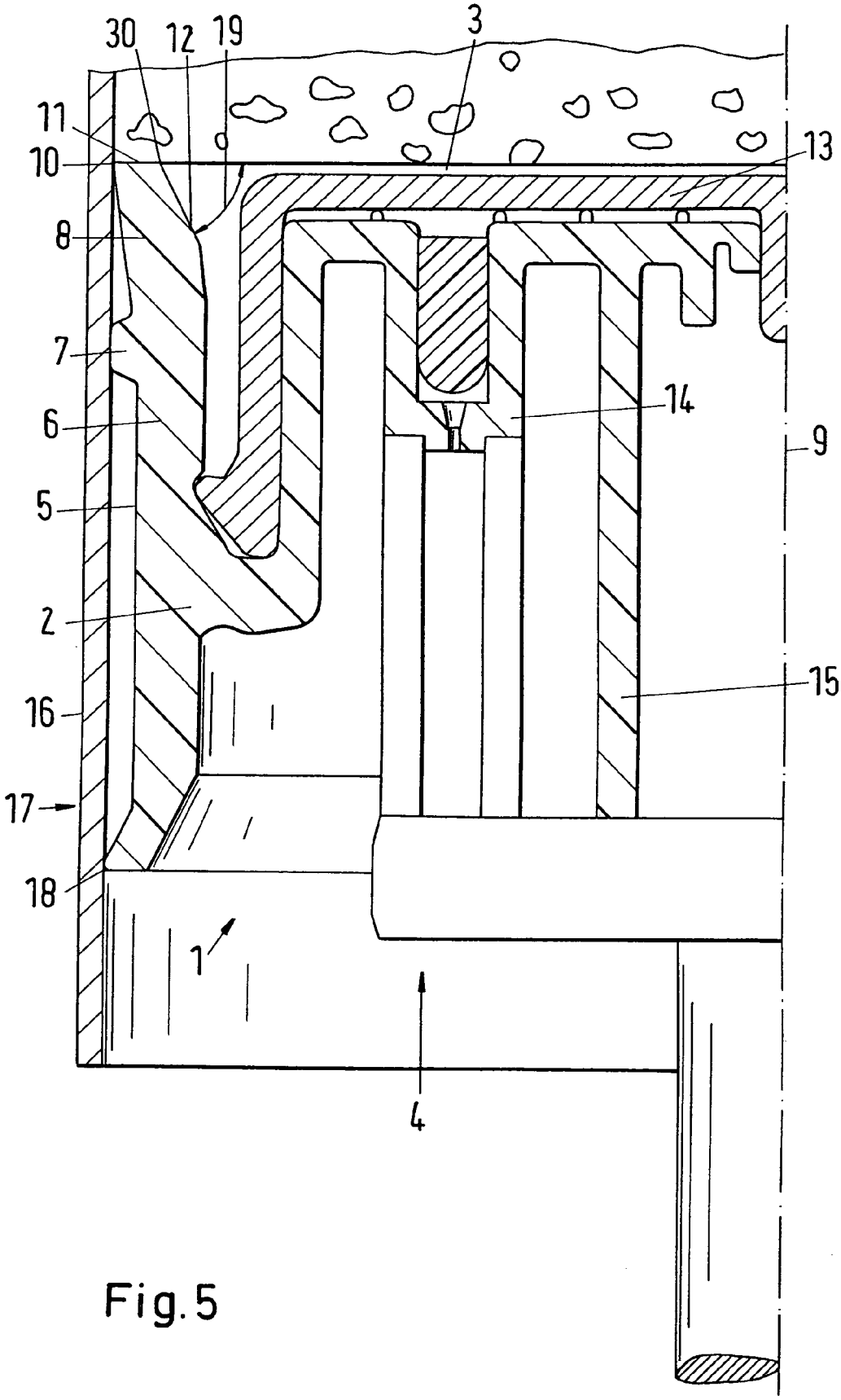
FIG. 5 illustrates a part cross-section of a piston in accordance with a first embodiment of the invention.

Referring to FIG. 5, the piston 1 in accordance with the invention includes a piston body 2 disposed on a longitudinal axis 9 which has a conveying side 3 transverse to the axis 9, an opposite drive side 4 transverse to the axis 9 and a circumferential piston jacket 5. The conveying side 3 is the boundary of the piston toward the filling; the drive side 4 the boundary in the direction of the discharge device. The piston jacket 5 connects the conveying side 3 and the drive side 4 and represents the boundary toward the wall 16 of the cartridge 17.

The piston 1 is provided with a protective element 13, a venting element 14 and stiffening ribs. The functions of the protective element 13, venting element 14 and stiffening ribs 15 do not differ from the prior art; reference is therefore made to the description of the prior art with respect to these elements.

The piston 1, i.e. the piston body 2 having a conveying side 3, an oppositely disposed drive side 4 and the piston jacket 5 at the circumferential side, is preferably a plastic component which is advantageously manufactured by an injection molding process.

The piston jacket 5 is in particular made rotationally symmetrical when the piston is intended for reception in a cylindrical cartridge. The piston jacket 5 merges on the conveying side 3 into a projection 6 that, in this embodiment, is a thin-walled rotationally symmetrical body which is visible as shown as an arm of the piston body 2.

The projection 6 has an annular guide element 7 for the guidance of the piston 1 in the cartridge 17 which guide element is suitable for establishing of sealing contact with the wall 16 of the cartridge 17. The guide element 7 can, in particular, be made as a sealing lip. If required, a plurality of sealing lips can also be provided.

The projection 6 includes an annular scraper element 8 which has a smaller spacing from the conveying side 3 than the guide element 7. The dimension of the piston 1 which is closest to the filling or which even reaches into the filling is determined for the determination of the spacing. With simple pistons, this dimension can be the piston surface or the protective element 13, for example a cover plate, covering the piston surface.

A tilt securing element 18 can be arranged on the drive side 4 of the piston and serves for the improvement of the guidance of the piston in a cartridge. The piston 1 is guided securely against tilting by the tilt securing element 18 which is in contact with the wall 16 of the cartridge 17, that is the axis of the piston body 2 coincides with the piston axis 9. It is ensured by the tilt securing element 18 that the conveying side 3 is arranged in a normal plane to the piston axis 9 or, if the conveying side 3 does not contain any planar surface or contains sections which do not lie in one plane, that points of the piston surface at the conveying side which are characterized by a specific radius and a specific height are disposed in substantially the same normal plane along the circumference. If the piston 1 were to tilt, the condition for such points would no longer be satisfied. A contact with the wall 16 of the cartridge at the circumferential side can thus be maintained during the whole discharge procedure by such a tilt securing element 18 so that a deflection of the piston can be prevented together with the previously described guide element 7.

In accordance with FIG. 5, it is the end of the piston jacket 5 at the conveying side which is made as a projection 6. A normal plane to the piston axis 9 is laid by the end of the piston jacket or optionally another point which satisfies the above criterion. The normal spacing between this normal plane from the scraper element 8 is compared to the normal spacing between the guide element 7 and this normal plane. The point of the guide element 7 is in particular selected at which the guide element 7 contacts the wall 16 of the cartridge 17. This point is representative for all the contact points of the guide element 7 with the wall 16 due to the rotational symmetry of the piston. The spacing between the contact point of the guide element and the plane characterizing the conveying side is therefore larger than the spacing of any desired point of the scraper element 8 from the previously named plane.

As illustrated, the scraper element 8 has an edge 10 located at the radially outermost point of a support surface 11 located in a plane transverse to the axis 9 of the piston 1 and this plane is spaced from the plane of the conveying side 3 of the piston.

The filling therefore only "sees" the scraper element 8 which contacts the wall 16 as soon as a compressive force is exerted onto the piston 1 during the discharge. The scraper element 8 thus lies in front of the guide element 7 in the direction from the filling to the piston. The advantage already results by this feature that the filling is directed along the support surface 11 in the direction of the piston axis on the discharge. Solid particles contained in the filling cannot pass the scraper element 8 due to the proximity of the scraper element to the wall. The edge 10 of the scraper element 8 contains the points of the scraper element 8 furthest away from the piston axis 9 in the radial direction. The term proximity to the wall is understood as the contact of the edge 10 of the scraper element at the wall or a small spacing thereof from the wall, with the spacing being smaller than average particle diameters to be expected.

The guide element 7 has a spacing from the piston axis 9 in the radial direction which is larger than or equal to the spacing of the edge 10 from the piston axis 9. The guide element 7 lies on the wall 16 of the cartridge 17 and seals the inner space of the cartridge containing the filling with respect to the environment so that a discharge of the filling to the drive side is prevented. The edge 10 has a radial spacing R1 from the piston axis and the guide element 7 has a radial spacing R2 from the piston axis, with the difference between R1 and R2 amounting to a maximum of 0.5 mm, preferably 0.3 mm, particularly preferably 0.2 mm. This spacing corresponds to the spacing of the edge 10 from the wall 16 of the cartridge as long as no compressive force is yet applied to the piston, that is therefore in a state in which the discharge has not yet been started.

The support surface 11 is arranged in a plane that is between 80° and 110° relative to the piston axis 9, and in particular, substantially normal to the piston axis 9. The support surface 11 is thus arranged such that any solid particles taken up by means of the scraper element 8 are discharged together with the filling. If the support surface 11 is arranged substantially normal to the piston axis, the solid particles can migrate in the direction of the piston axis. A collection of solid particles can thus be prevented in the region close to the wall.

It has been found to be particularly advantageous if the support surface 11 has a section 12, i.e. an inner annular surface defining an angle 19 of up to 80°, preferably up to 60°, particularly preferably up to 45° with the support surface 11. The angle 19 can be determined as follows: a normal plane to the piston axis 9 is laid by the edge 30 of the surface facing the piston axis 9. This normal plane is intersected by a plane which extends in the direction of the piston axis and which contains the edge 30 so that a straight sectional line results. The angle 19 is spanned between the intersection and the section line of the section 12 with the plane extending in the direction of the piston axis. The inclination of the section is in the direction of the drive side, that is each point of the section 12 which is remote from the edge 30 has a smaller spacing from the drive side than the point at which the edge 30 intersects the sectional plane of the drawing. The inclination of the section 12 thus takes place in the direction of the drive side.

Figure 6:
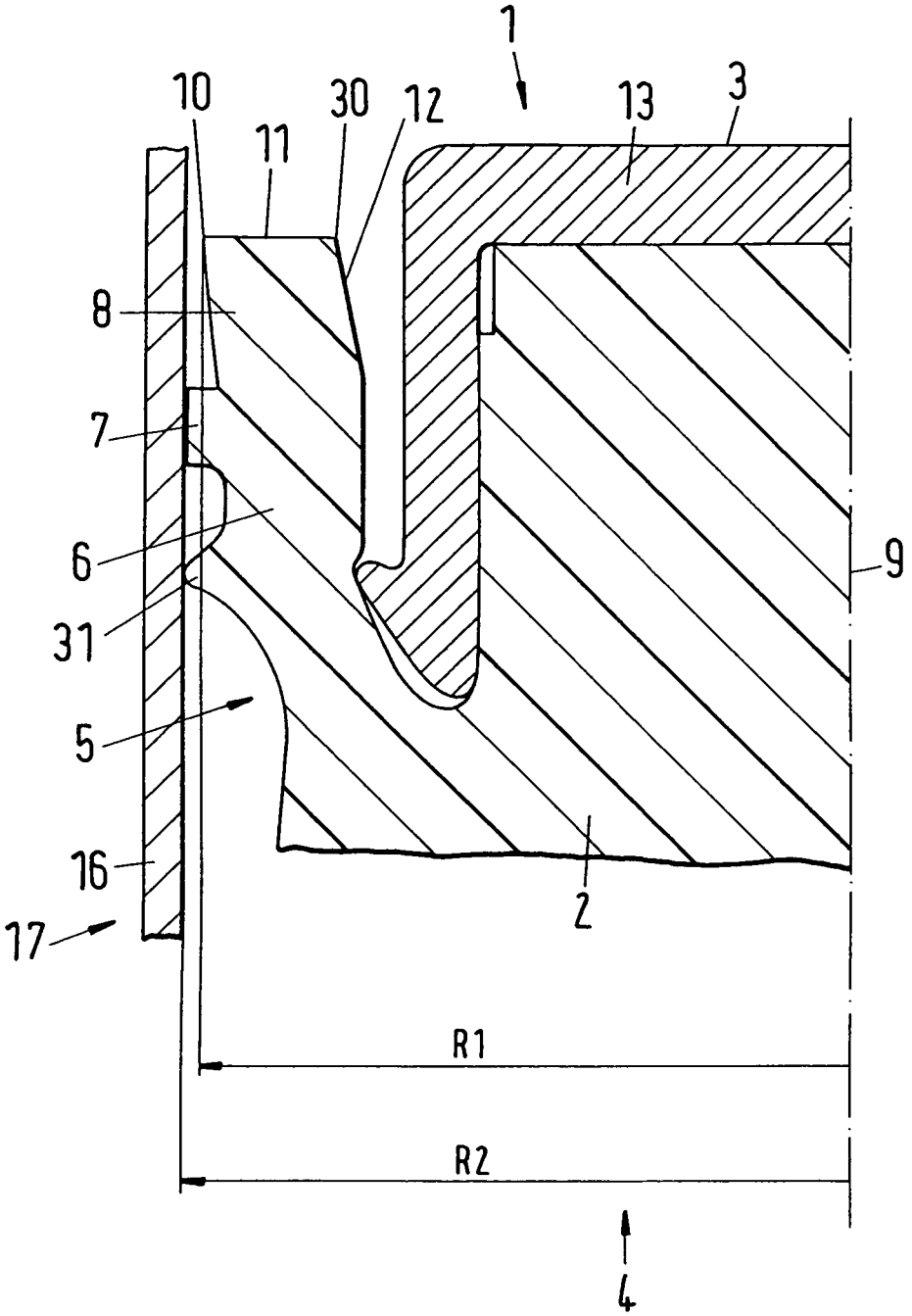
FIG. 6 illustrates a modified cross-sectional detail of the piston of FIG. 5.

Referring to FIG. 6, wherein like reference characters indicate like parts as above, the piston of FIG. 5 may be modified to have an arm that projects from the piston body 2 in the direction of the wall 16 of the cartridge 17 form the projection 6 from which the annular guide element 7 and annular scraper element 8 extend. In addition, an annular sealing lip 31 is provided on the projection 6 below the guide element 7, as viewed.

The further sealing lip 31 is in particular of advantage when the piston has a tendency to adopt an oblique position with respect to the piston axis. Possible leaks which result from this oblique position are prevented by the provision of the added sealing lip 31 or of a plurality of sealing lips. The application of a further sealing lip also has the advantage that, on damage to the guide element 7 or to the first sealing lip attached thereto, a further sealing lip is still present so that it is ensured that the filling can definitely not be discharged to the drive side 4.

Furthermore, the scraper element 8 as shown in FIG. 6 has a small spacing from the wall 16 of the cartridge 17. This scraper element 8 includes a support surface 11 which extends almost over the total width of the projection 6 reaching from the edge 10 up to the edge 30 in the sectional representation. For a rotationally symmetrical piston, it applies that this support surface 11 is made in ring shape. The section 12 adjoining the support surface 11 has a surface including a large angle which is between 60° and 90° with the normal plane on the piston axis 9 extending through the edge 30. How much the scraper element 8 is pressed toward the wall 16 during the discharge can be influenced by the selection of the inclination of the section 12.

Figure 7:
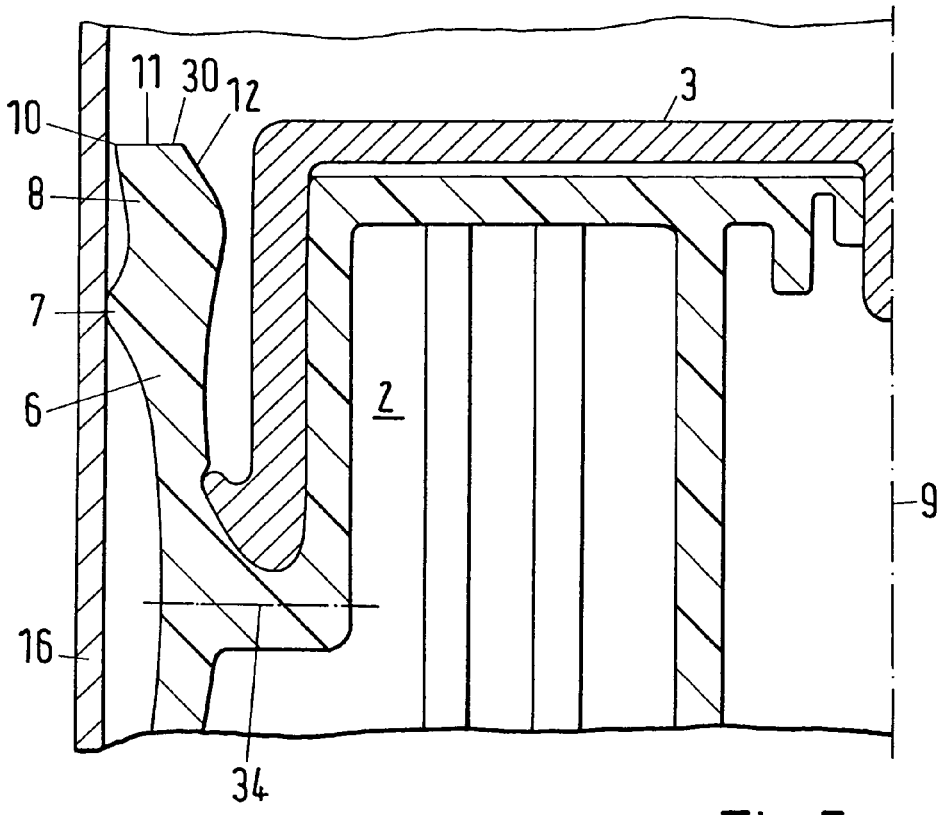
FIG. 7 illustrates a representation of the start of the discharge of a filling containing solids using a piston in accordance with FIG. 5.
Figure 8:
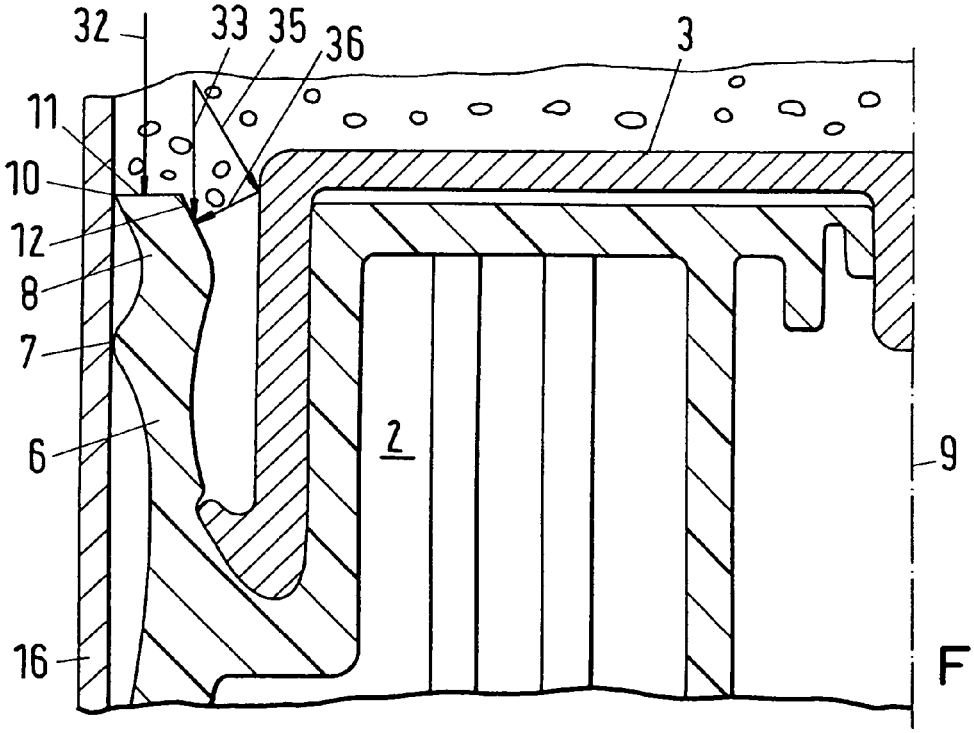
FIG. 8 illustrates a representation of the discharge of a filling containing solids using a piston in accordance with FIG. 5.

FIG. 7 and FIG. 8 show two different positions of the piston 1, a position of rest is shown in FIG. 7. The piston adopts this position of rest before the start of the discharge. this position of rest corresponds to the position in which the filled cartridge can be transported and stored.

FIG. 8 shows a position at a point in time during which an emptying takes place, that is, a discharge of the filling from the cartridge.

Referring to FIG. 8, the forces on the support surface 11 and on the section 12 are drawn to illustrate the forces acting on the piston and thus also on the scraper element 8 during a discharge. A compressive force 32 acts on the support surface 11 which is aligned substantially normal to the piston axis 9. This compressive force 32 generates a compression stress in the interior of the projection 6. In addition, a bending moment can be introduced into the projection 6 when the compressive force 32 does not act on the support point, but is offset with respect to the support point. In this respect, the support point is defined as the point of the shoulder 34 (see FIG. 7) which corresponds to the focus of a sectional plane extending through the shoulder. The sectional plane is laid so that it divides the shoulder into two substantially equal parts, measured at the smallest cross-section.

Since a soft, yielding plastic is preferably used as the piston material, the projection 6 deforms under the action of the compressive force 32 such that a compression and a bending occurs around the support point. Either a deformation of the projection 6 and of the scraper element 8 is thus already caused or the tendency to a deformation is amplified by the applied bending moment in dependence on the wall thickness of the projection 6.

In addition, a compressive force 33 engages along the section 12. As already shown in connection with FIG. 3 and FIG. 4, this compressive force can be divided into a tangential component 35 and a normal component 36. The normal component 36 can in turn be divided into a radial component which faces in the direction of the wall 16 and into an axial component which is arranged parallel to the piston axis 9. It results from this that the scraper element 8 is moved toward the wall 16 by this radial component until the edge 10 comes into contact with the wall.

Figure 9:
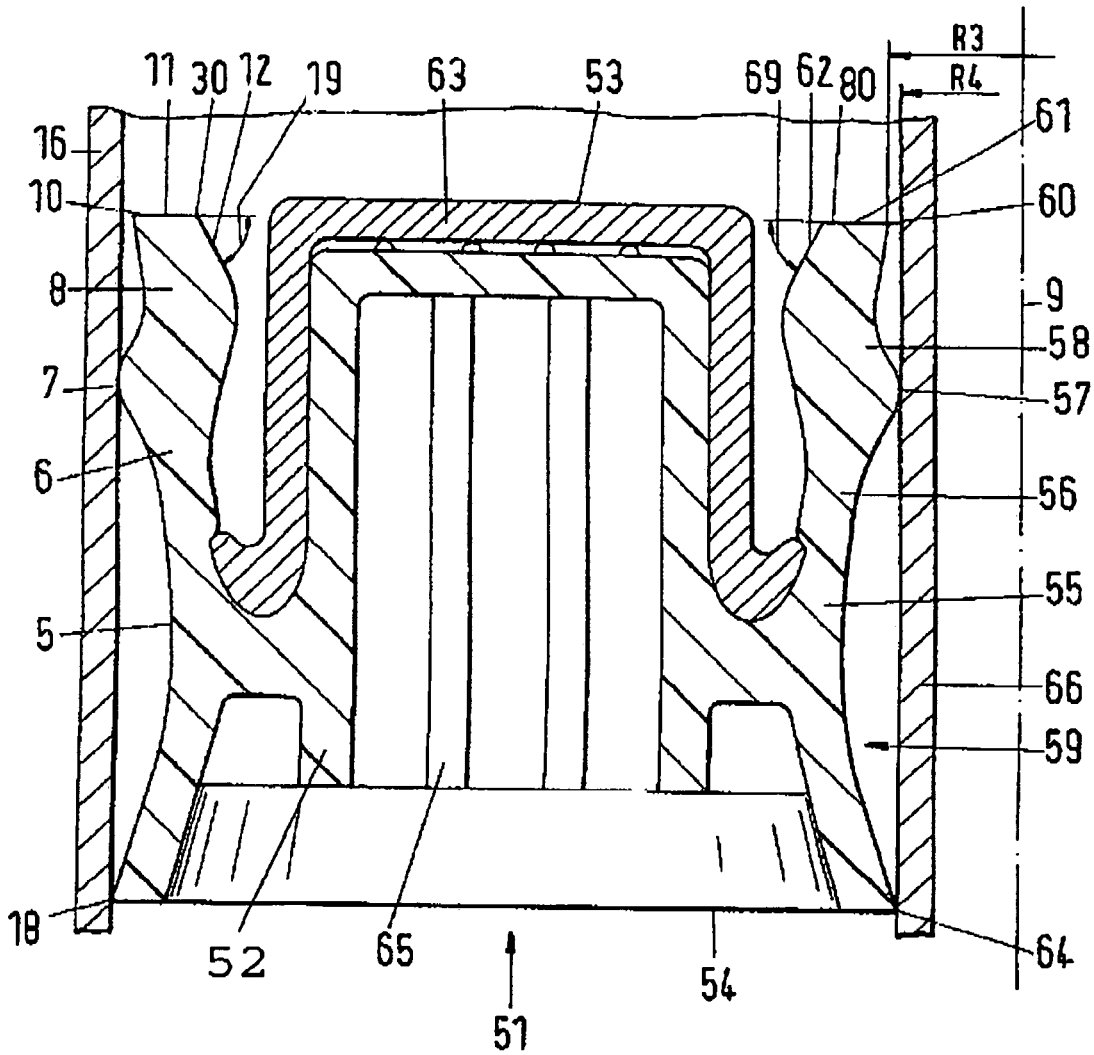
FIG. 9 illustrates a cross-section of an annular piston in accordance with a further embodiment of the invention.

Referring to FIG. 9, wherein like reference characters indicate like parts as above, an annular piston 51, such as is used for coaxial cartridges, may be constructed in accordance with the invention. In this embodiment, two or more cylindrical hollow spaces arranged coaxially to one another are arranged in a coaxial cartridge. Each of these hollow spaces is filled with a component. The inner hollow space or spaces are completely surrounded by the outer hollow space which is made as a cylindrical cartridge.

The annular piston 51 includes a piston body 52 which is usually manufactured by means of an injection molding process from plastic. The annular piston 51 is preferably used to discharge a filling, in particular of fluid or pasty media from a cartridge. The filling can in particular also contain solid particles. A wall 16 of the cartridge 17 is shown. The annular piston 51 slides along the wall 16 and, in this movement, pushes the filling out through a discharge opening, not shown. The side of the piston 51 at the media side is referenced as the conveying side 53 in the following.

To set the piston 51 into motion and to keep the piston in motion, a compressive force is applied by means of a discharge device. The discharge device (not shown) is located on the side of the piston which is disposed opposite the conveying side 53. This side is referenced as the drive side 54 in the following.

The piston body 52 is thus bounded by the drive side 54, by the conveying side 53 as well as by an outer piston jacket 5 and an inner piston jacket 55. The outer piston jacket 5 can have the same structure as described under FIG. 5 to FIG. 8. The inner piston jacket 55 forms the inner connection between the drive side 54 and the conveying side 53. The inner piston jacket 55 bounds the piston body 52 at an inner side 59 facing the piston axis 9.

The inner piston jacket 55 merges on the conveying side 53 into a projection 56. The projection 56 in the embodiment is a thin-walled rotationally symmetrical body which is visible in the sectional representation as an arm of the piston body 52. The projection 56 has an inner guide element 57 for the guidance of the piston along, that is in the direction of, the piston axis 9, for example along an inner tube 67. The guide element 57 is suitable for the establishment of a sealing contact with a wall 66 of the inner tube 67. The guide element 57 can in particular be made as a sealing lip. If required, a plurality of sealing lips can also be provided.

The projection 56 includes a scraper element 58 which has a smaller spacing from the conveying side 53 than the guide element 57. The dimension of the piston which is closest to the filling or which even reaches into the filling is determined for the determination of the spacing. With simple pistons, this dimension can be the piston surface or the protective element 63, for example a cover plate, covering the piston surface. A normal plane to the piston axis is laid by the surface of the protective element 63 at the conveying side. The normal spacing between this normal plane from the scraper element 58 is compared with the normal spacing between the guide element 57 and the normal plane.

The point of the guide element 57 is in particular selected at which the guide element 57 contacts the wall 66 of the inner tube 57. This point is representative for all the contact points of the guide element 57 with the wall 66 due to the rotational symmetry of the piston. The spacing between the contact point of the guide element 57 and the plane characterizing the conveying side is therefore larger than the spacing of any desired point of the scraper element 58 from the previously named plane. The filling therefore only "sees" the scraper element 58 which contacts the wall 66 as soon as a compressive force is exerted onto the piston during the discharge. The scraper element 58 thus lies in front of the guide element 57 in the direction from the filling towards the piston. The advantage already results by this feature that the filling is directed along the support surface 61 in the direction of the piston axis on the discharge.

Solid particles contained in the filling cannot pass the scraper element 58 due to the proximity of the scraper element to the wall 66. The scraper element 58 in particular has an edge 60 that contains the points of the scraper element 58 closest to the piston axis 9 in the radial direction. The term proximity to the wall is understood as the contact of the edge 60 of the scraper element 58 at the wall or a small spacing thereof from the wall, with the spacing being smaller than average particle diameters to be expected.

The guide element 57 has a spacing from the piston axis 9 in the radial direction which is smaller than or equal to the spacing of the edge 60 from the piston axis 9. The guide element 57 lies on the wall 66 of the cartridge and seals the inner space of the cartridge containing the filling with respect to the environment so that a discharge of the filling to the drive side is prevented. The edge 60 has a radial spacing R3 from the piston axis 9 and the inner guide element 57 has a radial spacing R4 from the piston axis, with the difference of R3 and R4 amounting to a maximum of 0.5 mm, preferably 0.3 mm, particularly preferably 0.2 mm. This radial spacing corresponds to the spacing of the edge 60 from the wall 66 of the inner tube as long as no compressive force is yet applied to the piston, that is therefore in a state in which the discharge has not yet been started.

The edge 60 bounds a support surface 61 which is arranged between 80° and 110° relative to the piston axis 9 and, in particular substantially normal to the piston axis 9. The support surface is thus arranged such that any solid particles taken up by means of the scraper element 58 are discharged together with the filling. If the support surface is arranged substantially normal to the piston axis, the solid particles can migrate in the direction of the piston axis. A collection of solid particles can thus be prevented in the region close to the wall.

It has been found to be particularly advantageous if the support surface 61 has a section 62 which includes an angle 69 of up to 80°, preferably up to 60°, particularly preferably up to 45° with the support surface 61. The angle 69 is measured from the support surface 61 or from the normal plane to the piston axis which contains the edge which is formed between the support surface 61 and the section 62. The inclination of the section is in the direction of the drive side, that is each point of the section 61 which is remote from the edge 80 has a smaller spacing from the drive side 54 than the point at which the edge 80 intersects the sectional plane of the drawing. The inclination of the section 62 thus takes place in the direction of the drive side 54.

The annular piston 51 can likewise contain a venting element (not shown), stiffening ribs 65 or a tilt securing element (18, 64).

The invention thus provides a piston for a cartridge for dispensing fillings containing solids which remains in sealing contact with the cartridge during discharge.

The invention further provides a piston for a cartridge for dispensing fillings containing solids that prevents solid particles from becoming lodged between the piston and the wall of the cartridge during discharge.

What is claimed is:

1. A piston including a piston body having a longitudinal axis, a conveying side transverse to said axis, a drive side transverse to said axis and opposite said conveying side and a circumferential piston jacket connecting said conveying side and said drive side, said piston jacket merging into a projection on the conveying side thereof and having an annular guide element for guidance of the piston in a cartridge and for forming a seal against a wall of the cartridge, said guide element being disposed in a plane transverse to said axis and spaced a first distance from said conveying side, an annular scraper element extending from said piston jacket and having a surface in a plane transverse to said axis and spaced a second distance from said conveying side smaller than said first distance, said scraper element having an edge at an outer periphery relative to said axis and wherein said guide element has a radial spacing from said axis larger than the radial spacing of said edge of said scraper element from said axis.

2. A piston as set forth in claim 1 wherein said edge of said scraper element has a radial spacing R1 from said piston axis and said guide element has a radial spacing R2 from said piston axis wherein the difference between R1 and R2 amounts to a maximum of 0.5 mm.

3. A piston as set forth in claim 1 wherein said surface of said scraper element is disposed at an angle between 80° and 110° relative to said piston axis.

4. A piston as set forth in claim 3 wherein said scraper element has an inner annular surface defining an angle of from 45° to 80° with said plane of said surface of said scraper element.

5. A piston as set forth in claim 1 wherein said scraper element is longitudinally spaced from said annular guide element.

6. A piston including a piston body having a longitudinal axis, a conveying side transverse to said axis, a drive side transverse to said axis and opposite said conveying side, an outer circumferential piston jacket connecting said conveying side and said drive side, and an inner circumferential piston jacket connecting said conveying side and said drive side, said outer piston jacket merging into a projection on the conveying side thereof and having a first annular guide element for guidance of the piston in a cartridge and for forming a seal against a wall of the cartridge, said guide element being disposed in a plane transverse to said axis and spaced a first distance from said conveying side, an annular scraper element extending from said piston jacket and having a surface in a plane transverse to said axis and spaced a second distance from said conveying side smaller than said first distance, said inner piston jacket merging into a projection on the conveying side thereof and having a second annular guide element for guidance of the piston on an inner tube and for forming a seal against the tube, said second guide element being disposed in a plane transverse to said axis and spaced a third distance from said conveying side, a second annular scraper element extending from said inner piston jacket and having a surface in a plane transverse to said axis and spaced a fourth distance from said conveying side smaller than said third distance, said second scraper element having an edge at an inner periphery relative to said axis and wherein said second guide element has a radial spacing from said axis smaller than the radial spacing of said edge of said first scraper element from said axis.

7. A piston as set forth in claim 6 wherein said edge of said second scraper element has a radial spacing R3 from said piston axis and said second guide element has a radial spacing R4 from said piston axis wherein the difference between R3 and R4 amounts to a maximum of 0.5 mm.

8. A piston as set forth in claim 6 wherein said surface of said second scraper element is disposed at an angle between 80° and 110° relative to said piston axis.

9. A piston as set forth in claim 8 wherein said second scraper element has an outer annular surface defining an angle of from 45° to 80° with said plane of said surface of said second scraper element.

10. A piston as set forth in claim 6 wherein said first distance and said third distance are of equal magnitude and said second distance and said fourth distance are of equal magnitude.

11. A discharge apparatus comprising a cartridge having a longitudinal axis; and a piston slidably mounted in said cartridge, said piston having a conveying side transverse to said axis, a drive side transverse to said axis and opposite said conveying side, and an outer circumferential piston jacket connecting said conveying side and said drive side, said piston jacket merging into a projection on the conveying side thereof and having an annular guide element forming a sliding seal against said cartridge, said guide element being disposed in a plane transverse to said axis and spaced a first distance from said conveying side, an annular scraper element extending from said piston jacket and having a surface in a plane transverse to said axis and spaced a second distance from said conveying side smaller than said first distance, said surface extending radially of said longitudinal axis with an edge located at a radially outermost point thereof, and wherein said guide element has a radial spacing from said axis larger than the radial spacing of said edge of said scraper element from said axis.

* * * * *